United States Patent [19]

Lázár

[11] Patent Number: 4,898,506

[45] Date of Patent: Feb. 6, 1990

[54] METHOD AND APPARATUS FOR MAKING A BOOK-BINDING

[76] Inventor: Peter Lázár, Tannenstr. 11, D-4040 Neuss 21, Fed. Rep. of Germany

[21] Appl. No.: 176,338

[22] Filed: Mar. 31, 1988

[30] Foreign Application Priority Data

May 14, 1987 [DE] Fed. Rep. of Germany ..... 3716112

[51] Int. Cl.[4] ..... B42C 11/04; B42C 7/00; B42C 9/00

[52] U.S. Cl. ..... 412/8; 412/17; 412/37

[58] Field of Search ..... 412/8, 17, 37; 281/21 R, 29, 34, 36, 7; 402/4; 428/327, 40; 156/477.1; 355/14 SH, 3 SH

[56] References Cited

U.S. PATENT DOCUMENTS

| | | | |
|---|---|---|---|
| 3,668,037 | 6/1972 | Blair | 412/8 |
| 3,902,646 | 9/1975 | Kuhns | 412/37 |
| 3,911,517 | 10/1975 | Davis | 412/37 |
| 3,920,501 | 11/1975 | Carlton et al. | 412/37 |
| 4,151,037 | 4/1979 | Klingelhoefer et al. | 412/37 |
| 4,367,061 | 4/1983 | Wiltolm | 412/3 |
| 4,376,008 | 3/1983 | Lauri et al. | 412/37 |
| 4,718,969 | 1/1988 | Lazar | 156/500 |

FOREIGN PATENT DOCUMENTS

| | | | |
|---|---|---|---|
| 3010642 | 10/1980 | Fed. Rep. of Germany . | |
| 3435704 | 3/1986 | Fed. Rep. of Germany . | |
| 2125735 | 3/1984 | United Kingdom | 412/8 |

*Primary Examiner*—Douglas D. Watts
*Assistant Examiner*—Paul M. Heyrana, Sr.
*Attorney, Agent, or Firm*—Shlesinger & Myers

[57] ABSTRACT

The method of manufacturing a book-binding comprises the steps of providing a book-binding sheet, providing a length of hot-melt strip material, orienting a portion of the material relative to the sheet, securing the portion to the sheet, and severing the secured portion from the remaining length.

20 Claims, 2 Drawing Sheets

METHOD AND APPARATUS FOR MAKING A BOOK-BINDING

Figure 1:
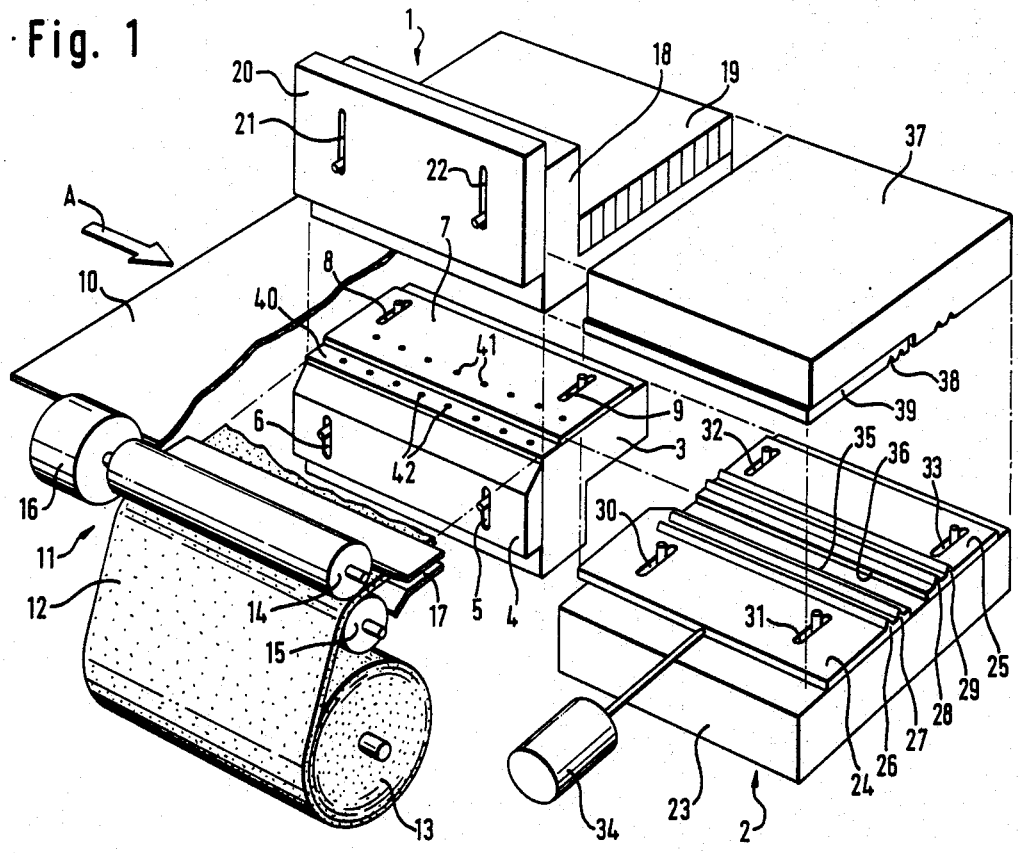

The invention concerns a method for making a book-cover, i.e. a binding, or the like, from a board having a hot-melt strip in a zone reserved for the binding back. The method includes the following procedural steps:

(a) a hot-melt strip is applied in such a manner relative to the board that the front edge of the hot-melt strip is flush with the binding back, (b) a hot-melt sub-strip is detached from the hot-melt strip, and (c) the hot-melt sub-strip is pressed against the board for fixation.

The invention furthermore relates to an apparatus for making a binding or the like from a sheet of material. The sheet is provided with a hot-melt sub-strip in a zone that shall become the binding back. The apparatus comprises the following elements (a) the apparatus includes a support for the binding, (b) the apparatus comprises a feed means to guide and transport a hot-melt strip transversely to the future longitudinal direction of the binding back, (c) the feed means terminates in a guide wall parallel to the support on the side of the hot-melt strip away from the board, (d) the end of the guide wall comprises a stop against which the front edge of the hot-melt strip, rests (e) a cutter is provided to sever a hot-melt sub-strip from the hot-melt strip, and (f) the apparatus includes a press to force the hot-melt sub-strip against the sheet.

Such a method and apparatus are described in the German Offenlegungsschrift No. 30 10 642, and in particular in relation to the embodiment shown in FIG. 4 of that document. The apparatus comprises a support for a board, this support essentially consisting of a base plate with rising bending brackets. A cardboard to make the binding can be deposited in such a way that the segment of the board reserved for the binding back comes to rest between the bending brackets. A feed means is present inside the base plate in the manner of a trough, and by means of which a hot-melt edge may be moved transversely to the future longitude of the binding back. A free space is provided between and below the bending brackets and receives a vertically displaceable punch. The front end of the hot-melt strip is inserted into this space until it comes to rest against a stop. The punch initially serves as guide wall or support. By moving the punch upwards, a hot-melt sub-strip is cut from the hot-melt strip and is of a length corresponding to the distance between the two bending brackets. The sub-strip is moved upwardly against the binding back, and lastly it is joined to this back the by application of heat and pressure.

The apparatus was found to be impractical because of difficulties in achieving reproducible separations of the hot-melt sub-strip from the hot-melt strip through use of the punch, and furthermore because the transport to the binding back did not succeed. It must be borne in mind that the hot-melt sub-strips frequently are very narrow and thin. Another drawback is that the hot-melt sub-strip perforce assumes a width—where such apparatus is employed—which corresponds to the spacing between the bending brackets. The distance between the troughs produced by the brackets therefore cannot be arbitrarily selected relative to the width of the hot-melt sub-strips.

Figure 3:
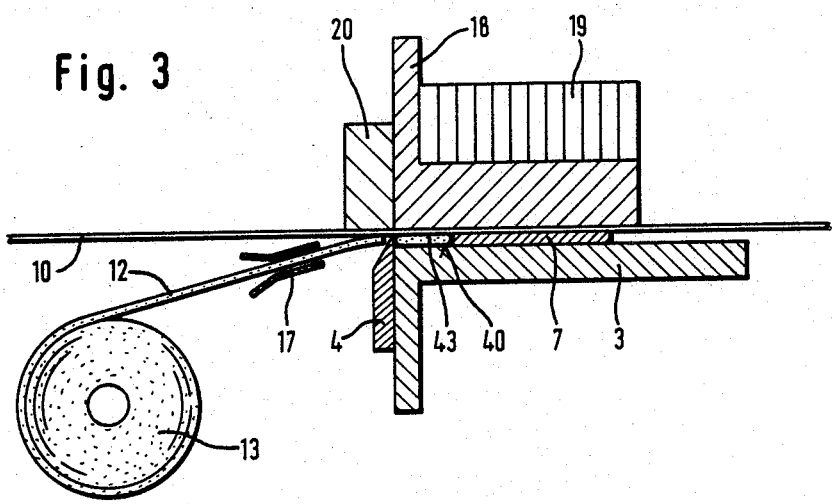

Because of the first cited drawback, the apparatus shown in FIG. 3 of the German Offenlegungsschrift No. 30 10 642 has come into use. Therein, the hot-melt sub-strips are cut off beforehand and placed into the space between the two bending brackets. This apparatus was developed further by means of the device shown in the German patent No. 34 35 704, where the hot-melt adhesive is introduced in liquid form. Automation could be improved thereby even though introducing the hot-melt adhesive in liquid form amounts to relatively high industrial complexity.

The object of the invention is to provide a method permitting book covers, to be produced i.e. bindings, in simple and reproducible manner and nevertheless at high speeds. Another object is to create an apparatus suitable to implement the method and characterized by simple design and by flexibility.

Based on the initially cited method, the object is solved by the following process steps:

(d) the hot-melt strip is moved to the board before the hot-melt sub-strips are detached, (e) the hot-melt sub-strip is detached from the hot-metal strip only when it is pressed against the board.

Therefore, contrary to the solutions of the state of the art, the invention does not first cut a sub-strip from the hot-metal strip and make it rest against the board only after a transport. Rather the hot-melt strip is moved by its front end which shall become the hot-metal sub-strip into the vicinity of the board. The front end will only be cut—thereby forming the hot-melt sub-strip—after it has come to rest. Thereby the advantage is obtained that the hot-melt sub-strip shall remain part of the strip until it rests against the board, and hence also shall still be guided by it. The ensuing severing and pressing then shall no longer be related to a transport process. Accordingly, the problems arising from the previously known apparatus have been eliminated. Moreover, higher outputs are possible with this method.

The invention is implemented by the hot-melt sub-strip being heated as it is being pressed against the board, thereby increasing the adhesion to the sheet.

In a further embodiment of the invention, the hot-melt strip shall be vacuum-held in the vicinity of the sub-strip to be detached, so that mutual slippage between the hot-melt strip and the board shall be prevented during the ensuing cutting.

The invention furthermore provides that upon apposition of the hot-melt sub-strip on the board, this board shall be moved further by at least by its length in the longitudinal direction of the hot-melt strip and shall only then be grooved. This division into two sequential process steps offers the advantage of substantially more freedom regarding the arrangement of the grooves relative to the hot-melt sub-strip, i.e., that the arrangement can be optimized. Advantageous guidance both in transport and grooving may be in the form of guide elements that move the binding so as to laterally rest against the hot-melt sub-strip.

As regards the apparatus, and based on that initially discussed, the object of the invention is achieved in that the planes of the guide wall and support as well as the stop, form a space in which the hot-melt strip is introduced. This gap arises tangibly only after the board rests on the support, and adds further support to the front end of the hot-melt strip by allowing it to assume a specific position once against the stop. Essentially, the spacing between the planes of guide wall and support should be about the thickness of the hot-melt strip, deviations in either direction are not critical. In this design, that part of the hot-melt strip moved into the gap practically no longer undergoes any significant displacement due to transport.

In an embodiment of the apparatus of the invention, the stop simultaneously is the support for the board. Furthermore, it should be displaceable in the direction of transport of the hot-melt strip, so that thereby the width of the hot-melt sub-strip may be easily changed. Appropriately, the stop is connected to lateral guide elements for the sheet, so that upon displacing the stop, there shall be simultaneously a corresponding displacement of the guide elements, whereby the cut off hot-melt sub-strip shall in fact come to be located in the zone of the board. Obviously, it is equally feasible to couple these lateral guide elements indirectly only to the stop in order to be able to make other formats also.

Appropriately the cutter is provided with a blade mounted next to the guide wall. Opposite this blade there should be a rest surface, toward which the blade shall move when the binding is inserted.

The pressing device may comprise a punch opposite the guide wall, whereby the hot-melt sub-strip is compressed against the inside of the board from the side away from the hot-melt sub-strip, i.e. the board outside. Obviously, the guide wall may be designed to be such a punch.

The press device and/or the guide wall additionally should have a heater to facilitate adhesion of the hot-melt sub-strip with the board.

the invention further proposes that the support and/or the guide wall be perforated, and the perforations be connected to a vacuum pump. Thereby, the binding and the part of the hot-melt strip resting on the guide wall shall be fixed in place, and are prevented from moving relative to each other until the press device becomes operative.

The invention proposes further that the apparatus include guide and transport devices to move the boards through the apparatus transversely to the direction of advance of the hot-melt strip. Thereby, automatic feed and removal of the board is made possible, and hence extensive automation of the entire production procedure. These devices are especially advantageous when the apparatus includes a grooving means for the boards, mounted in the direction of transport of the boards beyond the hot-melt strip feed device, whereby grooving will take place after the hot-melt sub-strip has been attached.

The grooving device should comprise at least two grooving ledges and a punch opposite these ledges, also guide means so the hot-melt sub-strip may rest on both sides. The guide means appropriately consist of two guide surfaces parallel to the grooving ledges. The spacing between the guide surfaces should be jointly variable with that between the grooving ledges. This may be implemented in that the guide surfaces are formed by the end faces of guide plates comprising the grooving ledges, and resting in different manner on a base plate.

The invention is illustrated in the drawing in relation to an embodiment.

Figure 2:
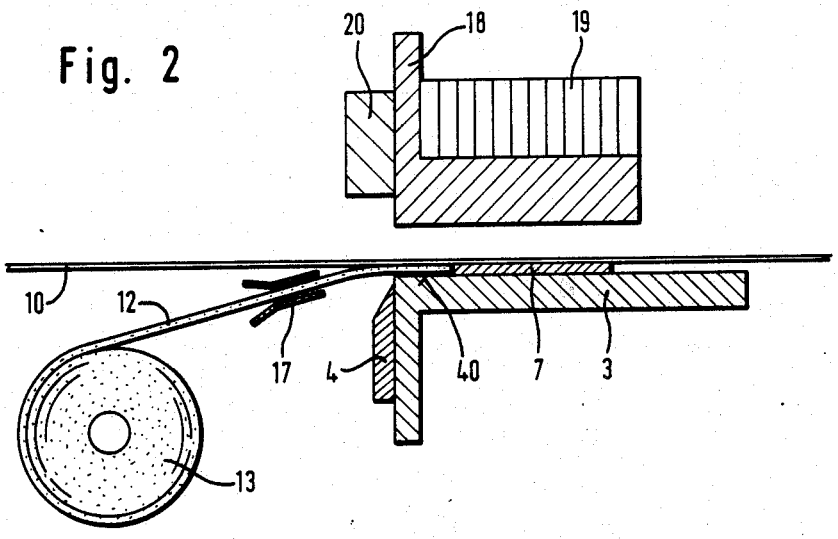

FIG. 1 is an apparatus for producing book covers, i.e. bindings, shown schematically and in perspective, FIG. 2 is a cross-section of the apparatus of FIG. 1 prior to the hot-melt sub-strip, being severed and FIG. 3 is the cross-section of FIG. 2 after the hot-melt sub-strip has been cut off.

Essentially, the apparatus shown in FIG. 1 consists of two parts. It comprises a bonding system 1 to fasten or bond a hot-melt sub-strip to a board, and further an adjoining grooving system 2 to impress grooves into the board on both sides of the hot-melt sub-strip. Both devices 1,2 are shown herein apart. In fact, however, they directly abut each other.

The bonding device 1 has a cross-sectionally L shaped cutting stage 3. A blade 4 is mounted on the vertical side, left in FIGS. 2 and 3, and is vertically displaced in guided manner, as indicated by the guide slots 5, 6. The drive for the blade 4 is omitted for the sake of clarity. Both electric motors and pneumatic or hydraulic actuators may be used.

A stop plate 7 is mounted at the upper side of the cutting stage 3 and can be displaced in the directions of the guide slots 8, 9 i.e. horizontally and transversely to the blade 4. The stop plate 7 simultaneously serves as a support for the board 10 which is inserted by advance and guide means, not shown herein in further detail, in the direction of the arrow A into the bonding device 1. Besides the stop plate 7, further rest means are present for the board 10, which again are omitted for the sake of clarity.

A feed system 11 to transport and guide a hot-melt strip 12 is mounted opposite the cutting stage 3. The hot-melt strip 12 is taken from supply roll 13 and is made to pass between two superposed rollers 14, 15. The upper roller 14 is driven by an electric motor 16 and advances the hot-melt strip 12 toward the cutting stage 3. Both the rollers 14, 15 and the electric motor 16 have been omitted from FIGS. 2 and 3.

An additional guide trough 17 is provided between the two rollers 14, 15 and the cutting stage 3 so that the hot-melt strip 12 is guided toward the upper side of the cutting stage 3.

A compression punch 18 also of cross-sectional L shape is located above the cutting stage 3 and comprises a heater 19, and may be displaced vertically. The drive and guide for the vertical motion of the punch 18 are omitted for the sake of clarity; they may be implemented by conventional technical means.

A depressor means 20 is mounted to the vertical front side of the punch 18, above the blade 4, and is jointly displaceable with the punch 18. In addition, the depressor may be raised or lowered relative to the punch 18, again in the vertical direction, as illustrated by the two guide slots 21, 22. The drive means for the depressor 20 is omitted from the drawing.

The grooving system 2 includes a stationary base plate 23 on which two grooving plates 24, 25 are mounted. The grooving plates each include two grooving ledges 26, 27, 28, 29. Their mutually opposite spacing can be varied, as indicated by means of the guide slots 30, 31, 32, 33. The grooving plate 24 which is in the front in the view of FIG. 1 is adjustable by electric motor 34. The end sides of the two grooving plates 24, 25 form guide surfaces 35, 36 of which the purpose shall be explained further below.

A press or punch 37 is located above the base plate 23 and the groove plates 24, 25, and the underside of the punch 37 comprises a recess, illustratively denoted by 38, matching each grooving ledge 26, 27, 28, 29. One half of the underside is designed to be a separate punch plate 39, and can be displaced in the same direction as the grooving plate 24 below, whereby the clearances 38 can be adjusted to be flush with the grooving ledges 26, 27. The punch 37 is vertically displaceable, its drive and guides having been omitted for the sake of clarity.

The apparatus operates as follows in the manufacture of a binding.

First a sheet 10 is inserted into the bonding in such a manner that the zone of the board 10 reserved for the binding back comes to rest precisely above the zone of the topside of the cutting stage 3 acting as guide wall 40. The board zone then is fixed in place by vacuum generated by air apertures 41 in the stop plate 7 that are connected to a vacuum pump.

Simultaneously, the hot-melt 12 is advanced transversely to the transport direction of the board 10, and thereby it enters the gap between this guide wall 40 and the sheet 10 until the front edge hits the stop plate 7. This is illustrated in FIG. 2. That part of the hot-melt strip 12 resting on the guide wall 40 also is kept in this position by vacuum, which here again is applied through air apertures 42 connected to a vacuum pump.

Up to this time, the punch 18 and the depressor 20 have remained a distance from the upper side of the board 10, as also shown in FIG. 2. Now the punch 18 is pressed on the board 10, whereby the board 10 at the latest now comes to rest against that part of the hot-melt strip 12 which rests on the guide wall 40. The hot-melt strip 12 is heated in this zone through the board 10, and thereby bonding or adhesion is achieved.

The depressor 20 at the same time is lowered on the upper side of the board 10. Directly thereafter, the blade 4 is moved vertically upward, whereby the front part of the hot-melt strip 12 is severed. A separate hot-melt sub-strip 43 has been created as best shown in FIG. 3, with a width matching that of the guide wall 40 and bonded by heat and pressure on that zone of the board 10 which, in the finished binding, shall be its back. This is illustrated in FIG. 3.

After the board 10 has been provided with a hot-melt sub-strip 43 in that manner, the punch 18 and the depressor 20 are raised again the the blade 4 is lowered. Simultaneously, the vacuum is replaced by compressed air, so that the board 10 can be moved in the direction of the arrow A to the grooving system 2. The board 10 is guided in this process above the hot-melt sub-strip 43 projecting from the underside. For that purpose, the guide surfaces 35, 36 are so spaced at the grooving plates 24, 25 that they adjoin both sides of the hot-melt sub-strip 43 and guide it, and hence also the board 10.

Once the board 10 has fully entered the grooving system 2, the punch 37 will be lowered. By compression, groove liens are formed on both sides of the hot-melt sub-strip 43 in the board 10, whereby the two covers can be grooved/folded relative to the binding back. As a result a binding has been made from the board 10 which may now receive a lift of sheets which can be bound by heating the hot-melt sub-strip 43.

The above method can be carried out in close sequences, that is, a subsequent board 10 may be inserted into the attachment system 1 and be provided with a hot-melt sub-strip 43 while the previous board is still being grooved. If suitable transport and guide means are employed, the method may be carried out fully automatically at high outputs.

I claim:

1. The method of manufacturing a book cover, comprising the steps of:

(a) providing a book binding board;
(b) providing a length of hot-melt strip material;
(c) orienting a portion of the material relative to the sheet;
(d) securing the portion to the board; and,
(e) severing the secured portion from the remaining length.

2. The method of claim 1, including the step of:
(a) securing the portion to the board by heating the portion and simultaneously pressing the portion against the sheet.

3. The method of claim 1, including the step of:
(a) maintaining orientation of the portion relative to the board sheet through the application of a vacuum.

4. The method of claim 1, including the step of:
(a) grooving the board adjacent opposite side edges of the portion after the portion has been secured to the sheet.

5. The method of claim 1, including the steps of:
(a) causing the secured together board and portion to be moved relative to the remaining portion of the length; and,
(b) grooving the board adjacent opposite side edges of the portion after the portion has been secured to the sheet.

6. The method of claim 1, including the steps of:
(a) causing the board to move in a first direction; and,
(b) orienting the portion by causing the portion to move in a second direction generally transverse to the first direction.

7. Apparatus for manufacturing a book cover, comprising:
(a) support means;
(b) feed means operably associated with said support means for supporting a board;
(c) feed means operably associated with said support means for causing a length of hot-melt strip material to be moved relative to the board and for being positioned below the board;
(d) said support means includes a plate defining a recess and having an upper surface for supporting the board and an edge portion engageable with an advancing edge of the strip material for causing the strip material to be stopped and thereby oriented relative to the overlying board and a base portion upon which the strip material is supported;
(e) punch means overlies said support means and are displaceable relative thereto for selectively engaging and pressing the board against the underlying strip material and thereby causing the board to be secured to the strip material; and,
(f) cutter means operably associated with said support means, underlying said recess and cooperating with said punch means for severing the strip material from said feed means as said punch means presses the board against the strip material.

8. The apparatus of claim 7, wherein:
(a) said plate has a thickness substantially equal to the thickness of the strip material.

9. The apparatus of claim 7, wherein:
(a) said plate is movable relative to said base portion for regulating the width of the strip material supported by said base portion.

10. The apparatus of claim 9, wherein said support means includes:
(a) first guide means extending from said base portion; and, (b) second guide means operably associated with said plate and with said first guide means for assuring orientation of said plate relative to said base portion upon displacement of said plate.

11. The apparatus of claim 7, wherein:

(a) said cutter means includes a blade displaceable generally transverse to said base portion.

12. The apparatus of claim 11, wherein:

(a) said punch means includes a lower rest surface; and, (b) said blade is engageable with said rest surface.

13. The apparatus of claim 7, wherein:

(a) means are operably associated with said punch means for causing heating thereof so that the strip material is bonded to the board.

14. The apparatus of claim 7, wherein said support means includes:

(a) a plurality of apertures in any one of said plate and said base portion; and, (b) vacuum pump means operably connected with said apertures for applying a vacuum thereto and for thereby maintaining orientation of the strip material relative to the board.

15. The apparatus of claim 7, wherein:

(a) said feed means is disposed generally transverse to the board.

16. The apparatus of claim 15, wherein:

(a) means are operably associated with said support means for displacing the secured together board and strip material in a direction generally transverse to the direction in which said feed means causes the strip material to be moved.

17. The apparatus of claim 16, further comprising:

(a) grooving means disposed adjacent said support means for receiving the secured together board and strip material and for grooving the sheet adjacent opposite side edges of the strip material.

18. The apparatus of claim 17, wherein said grooving means includes:

(a) first and second spaced parallel grooving ledges; and, (b) second punch means disposed adjacent said ledges and displaceable relative thereto for selectively engaging a secured together board and strip material and for causing the secured together board and strip material to be pressed against said ledges.

19. The apparatus of claim 18, wherein:

(a) means are operably associated with said grooving ledges for causing displacement of one ledge relative to another.

20. A machine for producing book covers, comprising:

(a) a bonding system for bonding a board to a length of hot-melt strip material and a grooving system disposed adjacent said bonding system for grooving the board adjacent opposite side edges of the strip material secured thereto;

(b) said bonding system comprises:

i. a support means including a first support surface and a support plate having a second support surface parallel to said first surface and said plate having a forward edge;

ii. first means for feeding a board in a direction parallel to said edge so that the board overlies and is supported by said second surface;

iii. second means for feeding a length of hot-melt strip material in a direction generally transverse to said edge and aligned with said edge so that an advancing edge of the strip material engages and is stopped by said plate edge and thereby positions the strip material beneath the board;

iv. punch means overlies said support means and are displaceable relative thereto for selectively pressing the board against the strip material and thereby causing the strip material to be secured to the board; and, v. cutter means operably associated with said support means and cooperating with said punch means for severing the strip material from said second feed means as said punch means presses the board against the strip material;

(c) means are operably associated with said bonding system for displacing the secured together board and strip material to said grooving system after the strip material has been severed;

(d) said grooving system comprises:

i. spaced parallel grooving ledges between which the strip material is received and above which the board is disposed; and, ii. second punch means overlies said ledges and are displaceable relative thereto for pressing the board against said ledges and thereby causing the board to be grooved.

* * * * *